US007201218B2

(12) United States Patent
Hiyama et al.

(10) Patent No.: US 7,201,218 B2
(45) Date of Patent: Apr. 10, 2007

(54) HEADER TANK FOR HEAT EXCHANGER

(75) Inventors: Jinichi Hiyama, Tatebayashi (JP); Masayoshi Shinhama, Sano (JP)

(73) Assignee: Calsonic Kansei Corporation (JP)

( * ) Notice: Subject to any disclaimer, the term of this patent is extended or adjusted under 35 U.S.C. 154(b) by 0 days.

(21) Appl. No.: 10/807,722

(22) Filed: Mar. 24, 2004

(65) Prior Publication Data

US 2004/0226705 A1 Nov. 18, 2004

(30) Foreign Application Priority Data

Mar. 31, 2003 (JP) ..... P2003-096895

(51) Int. Cl.
*F28F 9/02* (2006.01)
*B23P 15/26* (2006.01)

(52) U.S. Cl. ..... 165/173; 165/175

(58) Field of Classification Search ..... 165/173, 165/175, 178, 153; 29/890.052; 138/157, 138/162, 166, 167, 171
See application file for complete search history.

(56) References Cited

U.S. PATENT DOCUMENTS 5,152,339 A * 10/1992 Calleson ..... 165/173
5,236,042 A * 8/1993 Kado ..... 165/149
5,297,624 A * 3/1994 Haussmann et al. ..... 165/173
5,329,990 A 7/1994 Chigira
5,450,896 A * 9/1995 Bertva et al. ..... 165/173
5,662,162 A 9/1997 Fukuoka et al.
5,816,321 A * 10/1998 Wijkstrom ..... 165/173
5,836,384 A * 11/1998 Wijkstrom et al. ..... 165/173
5,896,923 A * 4/1999 Baba ..... 165/173
6,062,303 A 5/2000 Ahn et al.
6,234,238 B1 * 5/2001 Koyama et al. ..... 165/78

FOREIGN PATENT DOCUMENTS

JP 7-27496 1/1995
JP 2001-194088 7/2001
JP 2002-318093 10/2002

* cited by examiner

*Primary Examiner*—Tho Duong
(74) *Attorney, Agent, or Firm*—Kilpatrick Stockton LLP

(57) ABSTRACT

A pipe of a header pipe is formed by combining two separated bodies separated along a longitudinal direction. The first separated body has a tube holding wall portion including an insertion hole inserting a flat tube thereto, and a pair of straight portions protruded from the tube holding wall portion in an approximately orthogonal direction and set along both sides in a width direction of the tube, and is formed in a C-shaped cross sectional shape.

14 Claims, 13 Drawing Sheets

HEADER TANK FOR HEAT EXCHANGER

CROSS REFERENCE TO RELATED APPLICATIONS

This application is based upon and claims the benefit of priority from the prior Japanese Patent Application No. P2003-096895, filed on Mar. 31, 2003; the entire contents of which are incorporated herein by reference.

BACKGROUND OF THE INVENTION

1. Field of the Invention

The present invention relates to a header tank for a heat exchanger such as a condenser or the like used in an air conditioner of a motor vehicle or the like.

2. Description of the Related Art

FIGS. 1 and 2 show a conventional heat exchanger (condenser) used in an air conditioner (Japanese Patent Application Laid-open No. H7-027496). As shown in FIG. 1, a condenser 1 is comprised of a pair of head tanks 11 and 12 opposing to each other, a plurality of flat tubes 13 arranged between the header tanks 11 and 12, and corrugated fins 14 interposed between the flat tubes 13 and 13.

Each of the header tanks 11 and 12 is comprised of a pipe 15, closing members 16 closing both end opening portions of the pipe 15, and partition plates 17 sectioning a passage extending in a longitudinal direction within the pipe 15. In this embodiment, the closing member 16 doubles as a joint with an outlet pipe or an inlet pipe.

As shown in FIGS. 1 and 2, a lot of tube insertion holes 18 for inserting the tubes 13 are formed according to a press molding in the pipes 15 constituting the header tanks 11 and 12.

The structure is made such as to prevent a cooling medium from leaking from the insertion hole 18 by fixing the tube 13, a periphery of the insertion hole 18 and the fin 14 according to a brazing after inserting the tube 13 to the tube insertion hole 18.

Within the condenser 1, the cooling medium flows within the tube 13 so as to meander between one header tank 11 sectioned by the partition plate 17 and another header tank 12.

The cooling medium is cooled by radiating heat to an air ventilating through a gap of the fins 14 between the tubes 13. Accordingly, the cooling medium introduced into the condenser 1 in a gas phase state is flow out in a liquid phase state from the condenser 1.

FIG. 3 is an exploded perspective view of the pipe 15, and FIGS. 4A and 4B are cross sectional views of the pipe 15.

As shown in FIGS. 3, 4A and 4B, the pipe 15 in the conventional header tanks 11 and 12 is comprised of combining two semi-cylindrical separated bodies 19 and 20. A cross sectional shape of each of the separated bodies 19 and 20 is formed in a semicircular shape. An approximately L-shaped receiving portion 19*a* is formed in one separated body 19 constituting the pipe 15 for the purpose of being brought into contact with an opening peripheral edge portion 20*a* of another separated body 20 so as to position.

However, in the conventional header tanks 11 and 12 for the heat exchanger, since the pipe 15 is formed in the cylindrical shape as shown in FIG. 4B, an inserting depth L1 of the tube 13 is large, and it is hard to secure a passage cross sectional area S of the pipe 15 in a state in which the tube 13 is inserted.

Therefore, in order to make the passage cross sectional area S of the pipe 15 large, it is necessary to make a diameter of the pipe 15 large, so that the pipe 15 is enlarged. On the other hand, in the case that the diameter of the pipe 15 is made small for the purpose of making the condenser 1 compact, there is a problem that the passage cross sectional area S of the pipe 15 can not be sufficiently secured.

The present invention is made for the purpose of solving the problem mentioned above, and an object of the present invention is to provide a header tank which can make a heat exchanger (a condenser) small while securing a passage cross sectional area of a pipe.

SUMMARY OF THE INVENTION

According to the present invention, there is provided a header tank for a heat exchanger in which a plurality of flat tubes are communicated and connected to at least a pair of header tanks so as to form a multiple stages, which is comprised of a pipe formed by combining a first separated body and a second separated body, a closing member for closing opening portions in both ends of the pipe, a tube holding wall portion inserting the flat tube provided in the second separated body thereto so as to hold, and a pair of straight portions protruded from the tube holding wall portion in an approximately orthogonal direction and formed along both ends in a width direction of the tube, wherein the holding wall portion and the pair of straight portions are formed in a C-shaped cross sectional shape.

BRIEF DESCRIPTION OF THE DRAWINGS

FIGS. 8A and 8B are views showing an outer diameter difference in a longitudinal direction X of the tube with respect to the conventional header tank, in which FIG. 8A is a cross sectional view of the header tank according to the present embodiment, and FIG. 8B is a cross sectional view of the conventional header tank;

FIGS. 9A and 9B are views showing an outer diameter difference in a width direction Y of the tube with respect to the conventional header tank, in which FIG. 9A is a cross sectional view of the header tank according to the present embodiment, and FIG. 9B is a cross sectional view of the conventional header tank;

DETAILED DESCRIPTION OF THE INVENTION

A description will be given below of an embodiment according to the present invention with reference to the accompanying drawings. In this case, since an entire structure of the heat exchanger is the same as the conventional one, a description thereof will be omitted.

Figure 5:
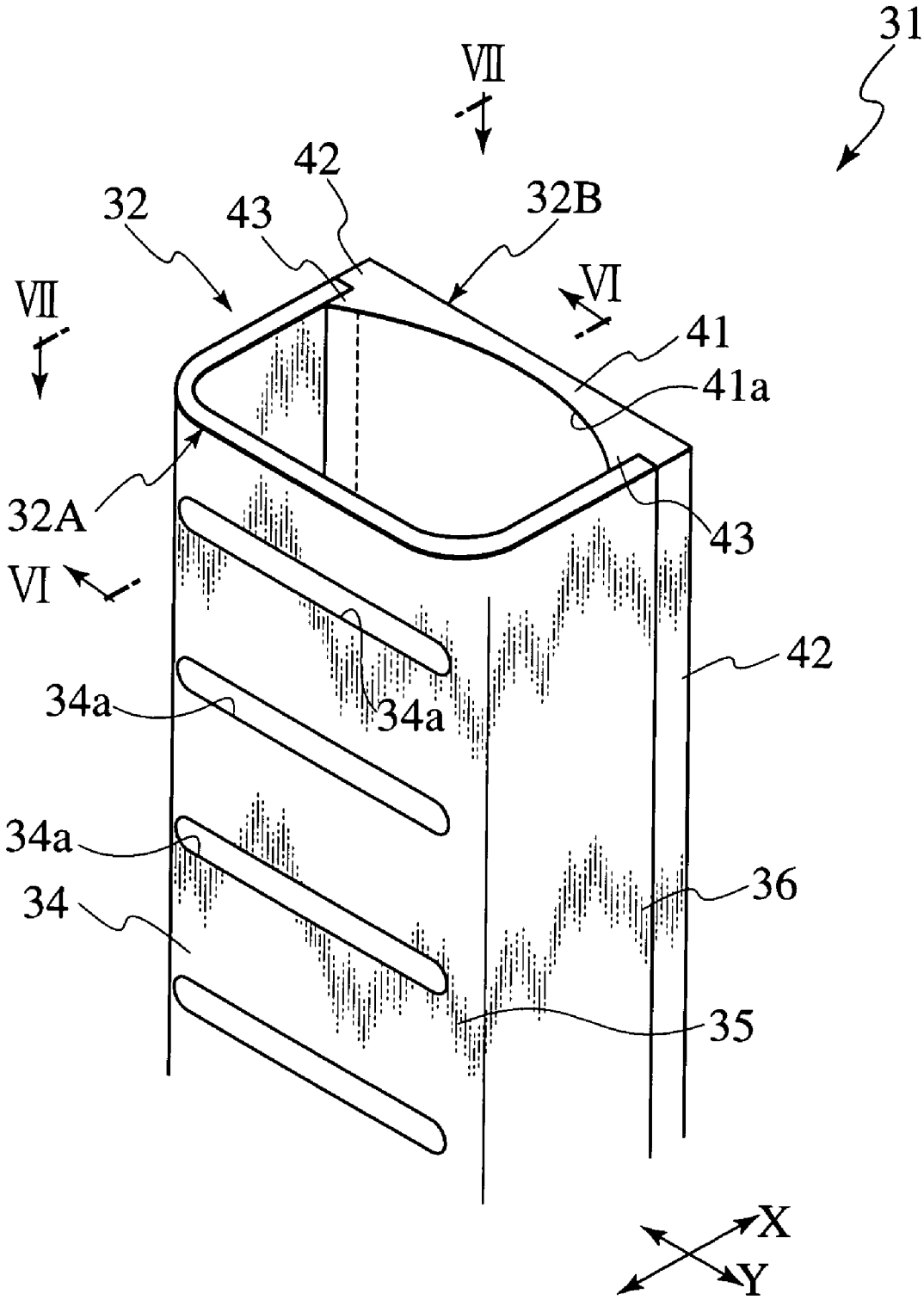
FIG. 5 is a perspective view of a pipe of a header tank according to the present invention.
Figure 6:
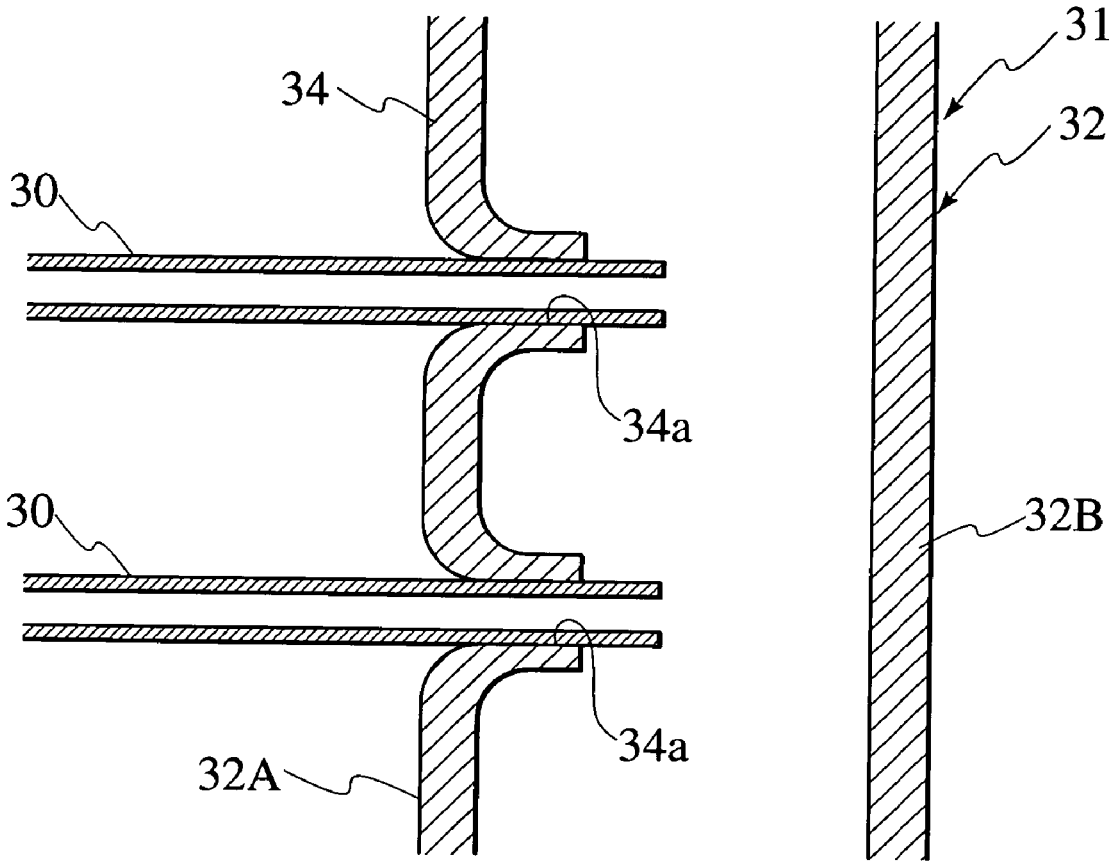
FIG. 6 is a cross sectional view along a line VI—VI in FIG. 5.

With reference to FIG. 5, a header tank 31 according to the present embodiment is comprised of a pipe 32, closing members (not shown) closing opening portions in both ends of the pipe 32, and a partition plate (not shown) sectioning a passage extending in a longitudinal direction within the pipe 32.

A description will be in detail given below of the pipe 32.

As shown in FIGS. 5 to 7B, the pipe 32 is formed in a tubular shape by combining two separated bodies 32A and 32B separated along a longitudinal direction.

The first separated body 32A is formed in a C-shaped cross sectional shape while being provided with a tube holding wall portion 34 and a pair of straight portions 36 protruded in an approximately orthogonal direction from both ends of the tube holding wall portion 34.

The tube holding wall portion 34 has at least one insertion hole 34*a* holding the inserted flat tube 30, and is formed in a tabular shape which is orthogonal to a longitudinal direction of the tube 30.

A pair of straight portions 36 are protruded in the approximately orthogonal direction from the tube holding wall portion 34 via a small-diameter curved portion 35, and are provided along both end portions 30*a* and 30*a* of the tube 30 in a width direction.

On the other hand, the second separated body 32B is provided with a main body portion 41 closing an opening portion 0 of the first separated body 32A. Abutment portions 42 brought into contact with a leading end surface 36*a* of the straight portion 36 in the first separated body 32A are formed in both ends of the main body portion 41.

Further, a joint projection 43 bonded to an inner peripheral surface 36*b* in a leading end portion of the straight portion 36 in the first separated body 32A is formed in an inner peripheral surface 41*a* of the main body portion 41. In other words, L-shaped joint surfaces 42*a* and 43*a* brought into contact with the leading end portion of the straight portion 36 in the first separated body 32A are formed in the second separated body 32B.

The main body portion 41 of the second separated body 32B is formed in such a manner as to approximately linearly connect the abutment portions 42 and 42 to each other so as to be approximately orthogonal to a longitudinal direction of the tube 30. Accordingly, the pipe 32 constituted by the first separated body 32A and the second separated body 32B is formed in a square tube shape in a cross section.

The inner peripheral surface 41*a* of the main body portion 41 in the second separated body 32B is formed in a circular curved shape obtained by connecting a pair of joint projections 43 and 43 to each other by a smooth surface, and the circular curved surface 41*a* is a curved surface bulging to an outer side. Accordingly, the structure is made such that a high durability is achieved against a pressure applied from an inner portion of the pipe 32.

Figures 8A, 8B:
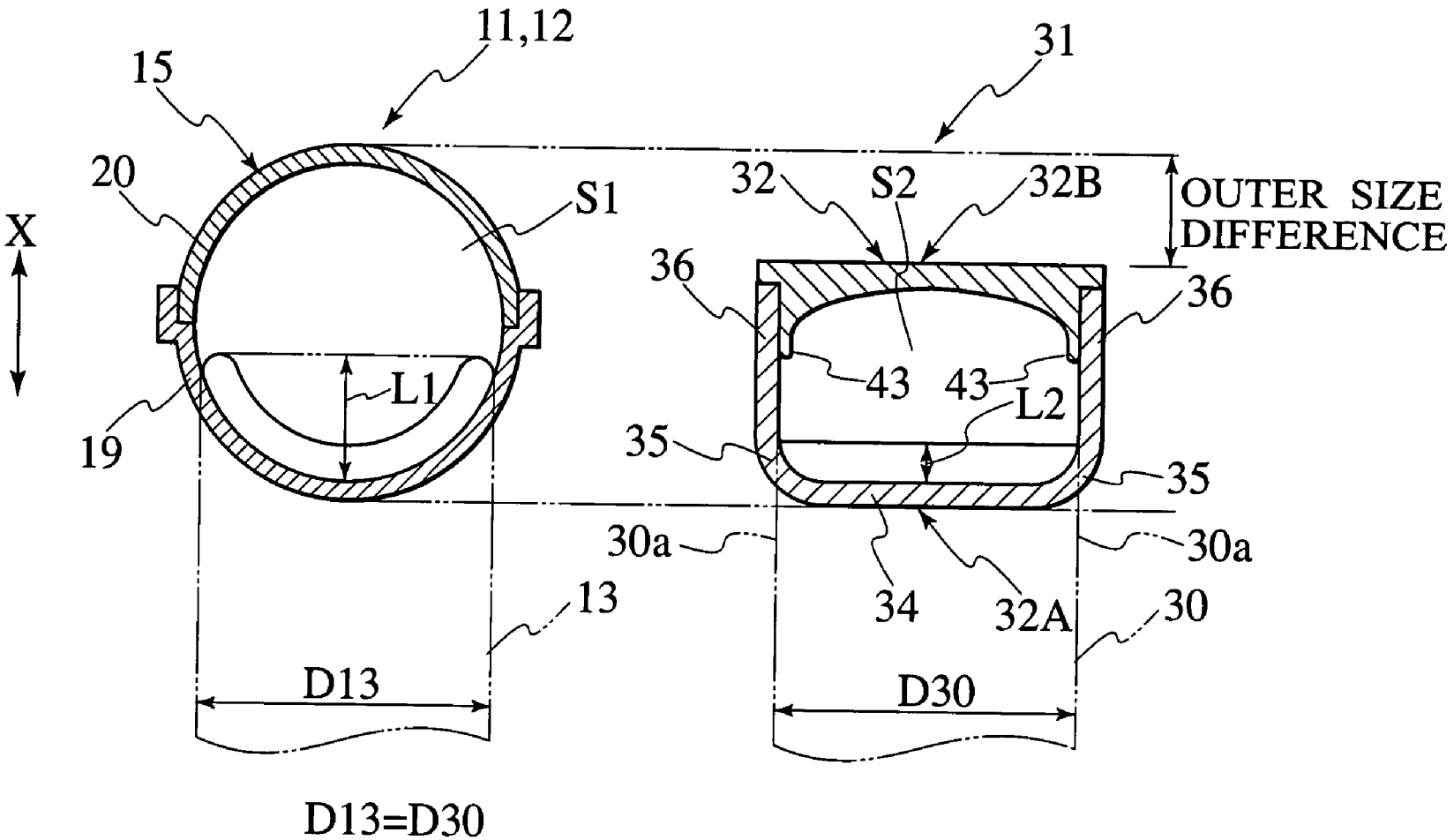

The pipe 32 having the structure mentioned above is manufactured by assembling the first separated body 32A and the second separated body 32B (while clamping the partition plate (not shown) to a predetermined position) as shown in FIG. 8A, thereafter caulking the straight portions 36 and 36 toward the joint projections 43 and 43 of the second separated body 32B so as to temporarily fix (refer to FIGS. 11A and 11B), and brazing in this state. More specifically, the heat exchanger is manufactured by integrally fixing the temporarily fixed pipe 32 according to the brazing, in a state in which the pipe 32 is assembled with the joint block, the closing member, the tube, the fin, the side plate and the like.

Figure 7A:
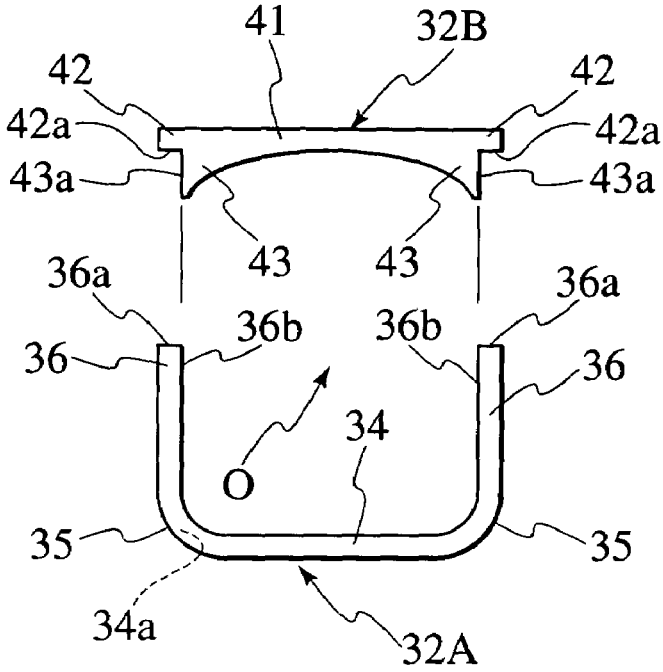
FIG. 7A is a cross sectional view of the pipe along a line VII—VII in FIG. 5 and shows an exploded state.
Figure 7B:
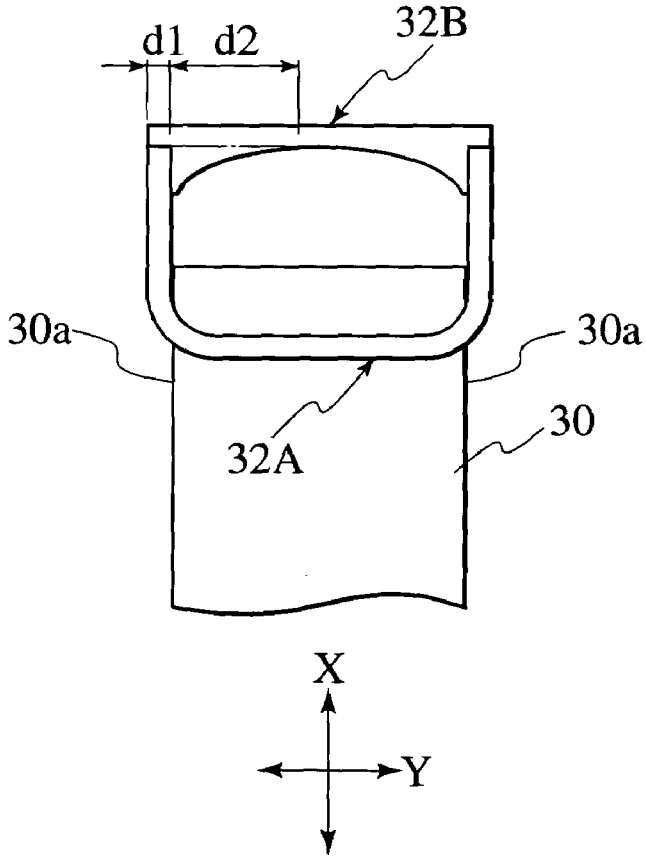
FIG. 7B is a cross sectional view of the pipe along the line VII—VII in FIG. 5 and shows a state in which the tube is inserted.

A length d2 of the base end portion of the joint projections 43 and 43 of the second separated body 32B along a caulking direction (directions of arrows AR1 and AR2 in FIG. 11B) is larger than a length d1 of the straight portion 36 of the second separated body 32A as shown in FIG. 7B. Accordingly, even in the case that the caulking force is applied, the joint projection 43 is prevented from being deformed.

According to the header tank 31 for the heat exchanger based on the embodiment mentioned above, the following effects can be obtained.

First, since the first separated body 32A is set to the C-shaped cross sectional shape as shown in FIG. 8A, an insertion depth of the tube 30 can be made shallow in comparison with the header tanks 11 and 12 employing the conventional pipe 15 having the circular cross sectional shape. Accordingly, it is possible to make the structure compact in a longitudinal direction X of the tube 30 while securing the same passage cross sectional area as that of the conventional pipe 15 having the circular cross sectional shape. In other words, in FIGS. 8A and 8B, a relation L1>L2 and S1≈S2 is satisfied.

Figure 15A:
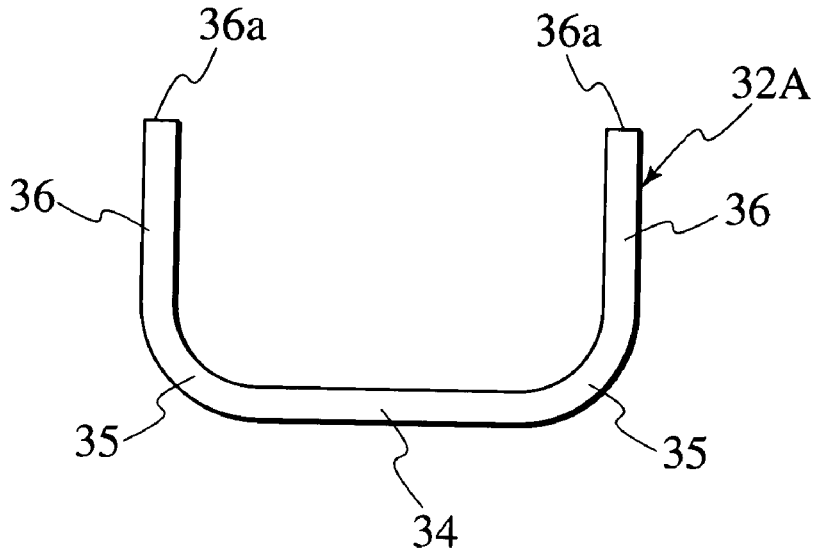
FIGS. 15A and 15B are views showing a modified embodiment of the first separated body in the pipe.
Figure 15B:
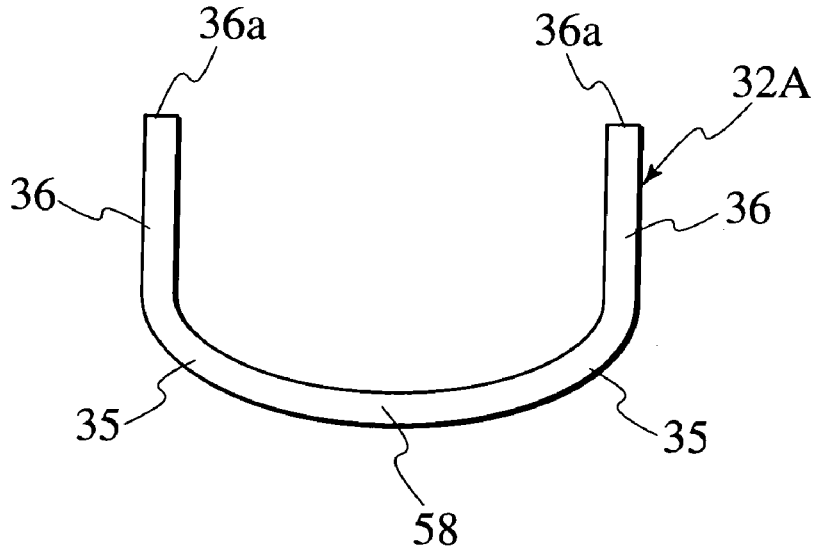

Secondly, since the tube holding wall portion 34 of the first separated body 32A is formed in a flat shape orthogonal to the longitudinal direction X of the tube 30, it is possible to make the structure more compact in the longitudinal direction of the tube. In this case, according to the present invention, a curved tube holding wall portion 58 may be employed as far as a curvature is larger than a curvature of the small-diameter curved portion 35 as shown in FIG. 15B. FIG. 15A shows the first separated body 32A according to the embodiment mentioned above for the purpose of comparing with FIG. 15B.

Figures 9A, 9B:
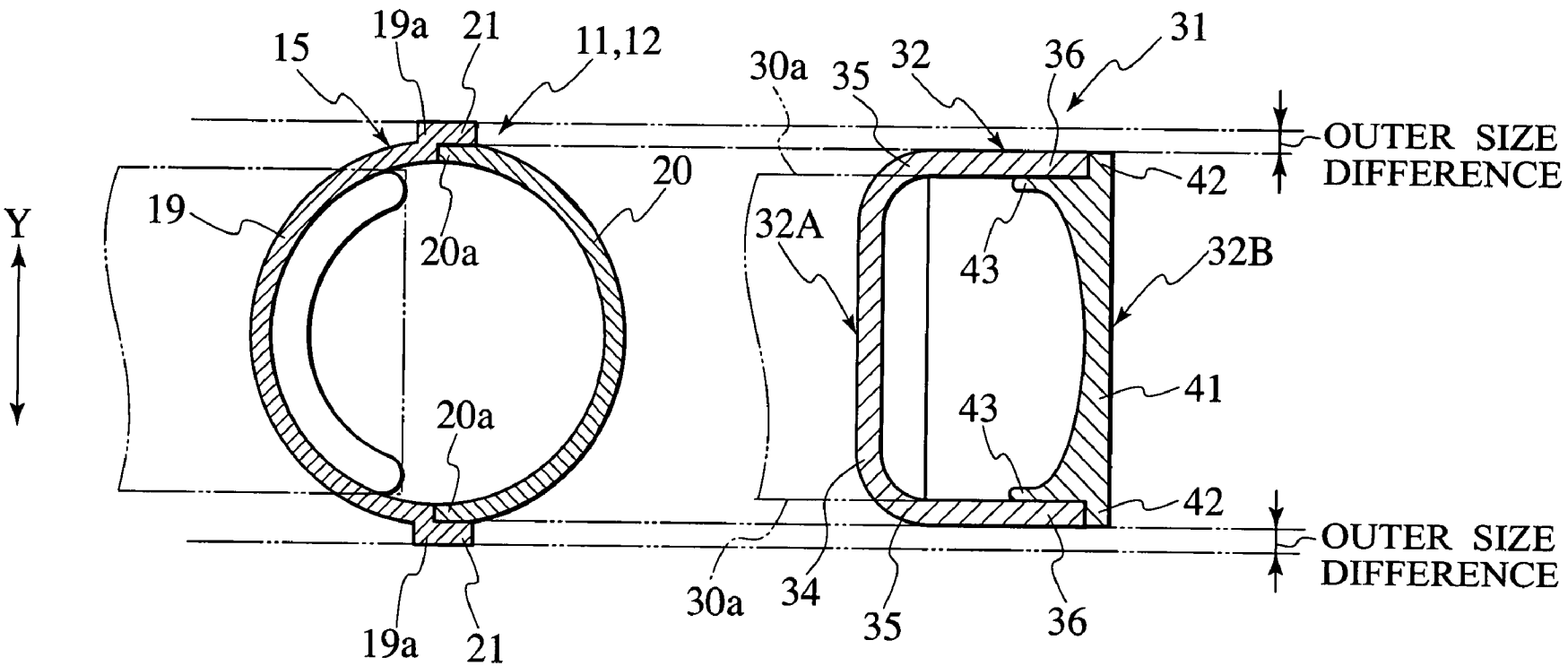
Figure 10A:
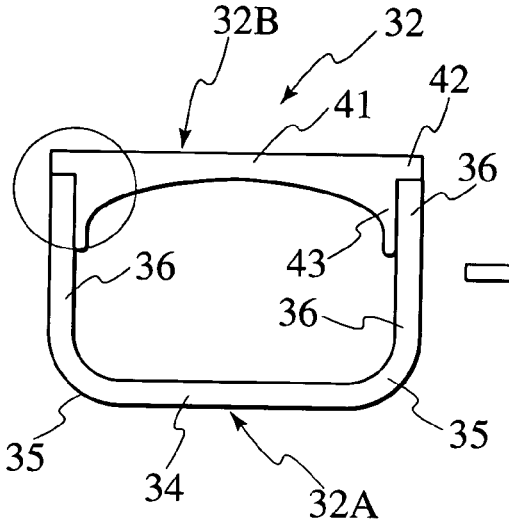
FIGS. 10A and 10B are views showing a step of temporarily fixing the pipe constituting the header tank.
Figure 10B:
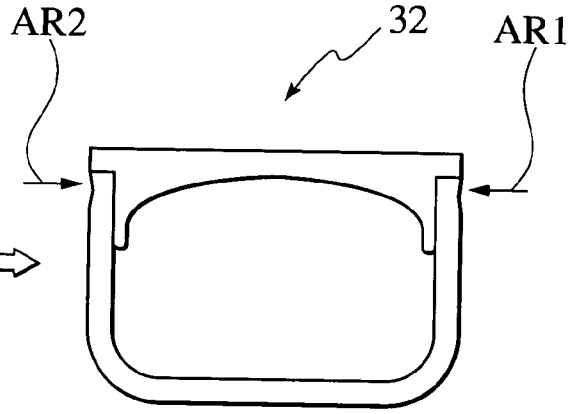

Thirdly, the second separated body 32B of the header tank 31 is comprised of the abutment portions 42 which are provided in both ends of the main body portion 41 and with which the leading end surface 36*a* of the straight portion 36 of the first separated body 32A is brought into contact, and the joint projection 43 which is protruded from the inner peripheral surface 41*a* of the main body portion 41 and is bonded to the inner peripheral surface 36*b* in the leading end portion of the straight portion 36. Accordingly, it is possible to assemble the first separated body 32A and the second separated body 32B while preventing both end portions 42 and 42 of the second separated body 32B from protruding out in the width direction Y of the tube 30 from the straight portion 36 of the first separated body 32A, as shown in FIGS. 9A and 9B. Accordingly, in comparison with the conventional structure in which the joint projection 21 as shown in FIG. 9B is provided in the outer side, the header tank 31 (the pipe 32) can be made compact in the width direction Y of the tube 30.

Further, in the cross sectional shape of the header tank 31, since the inner peripheral surface thereof comes close to the circular shape owing to the existence of the joint projections 43 and 43, the durability of the header tank 31 is further improved. In this case, it is not necessary that the leading end surface 36*a* of the straight portion 36 is brought into contact with the abutment portion 42. In other words, in the case that the size of the partition plate interposing in the pipe 32 is set large, there is a case that the abutment portion 42 and the leading end surface 36*a* of the straight portion 36 are apart from each other.

Fourthly, since the main body portion 41 of the second separated body 32B is formed in a linear shape, it is possible to make the header tank 31 (the pipe 32) more compact along the longitudinal direction X of the tube 30.

Fifthly, since the inner peripheral surface 41*a* of the main body portion 41 of the second separated body 32B is formed in the circular curved surface, an excellent pressure resistance can be achieved in comparison with the case that the entire of the inner peripheral surface of the pipe is formed in the polygonal cross sectional shape, while making the pipe 32 compact.

Sixthly, since the first separated body 32A and the second separated body 32B are temporarily fixed to each other by the caulking work of the straight portion 36 in the first separated body 32A, a jig for temporarily fixing the first separated body 32A and the second separated body 32B is not required at a time of brazing, and a wasteful heat capacity is not dissipated.

Seventhly, since the base end portions of the joint projections 43 and 43 in the second separated body 32B are formed thicker than the straight portion 36 of the first separated body 32A along the caulking direction Y, the joint projections 43 and 43 in the second separated body 32B do not fall down due to the caulking force, and it is possible to temporarily fix the first separated body 32A and the second separated body 32B securely.

A modified embodiment according to the present invention will be described bellow.

Figure 14A:
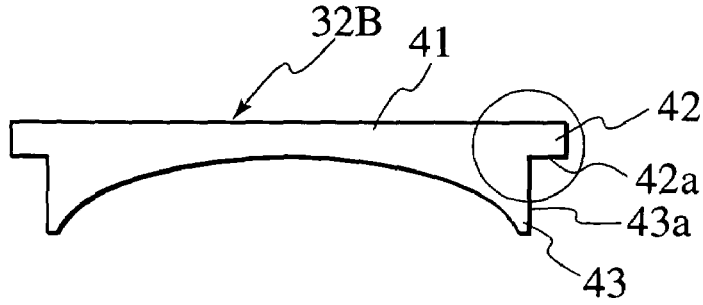
FIGS. 14A to 14D are views showing a modified embodiment of the second separated body in the pipe.
Figure 14B:
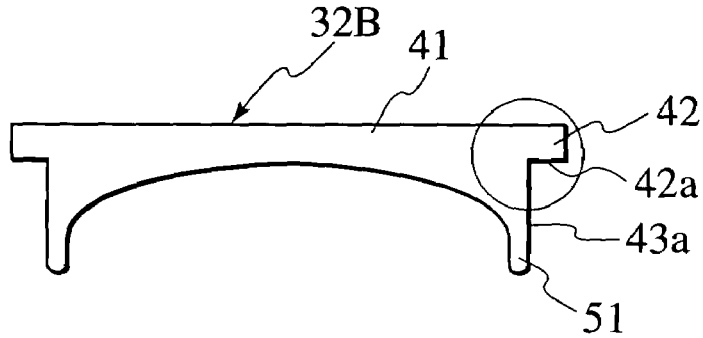
Figure 14C:
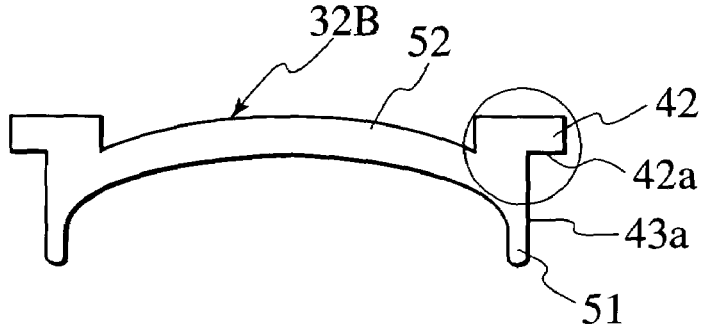
Figure 14D:
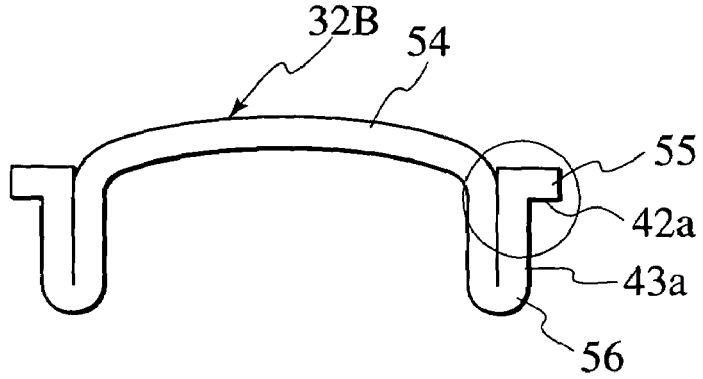

FIGS. 14A to 14D show a modified embodiment of the second separated body 32B. In other words, according to the present invention, joint projections 51 and 51 may be provided as shown in FIG. 14B. Further, a main body portion 52 may be formed in a curved shape as shown in FIG. 14C. Further, a main body portion 54, an abutment portion 55 and a joint projection 56 may be formed by press molding one sheet of flat member as shown in FIG. 14D in place of extrusion molding the second separated body 32B. In this case, FIG. 14A shows the second separated body 32B according to the embodiment mentioned above for comparison.

Figure 11A:
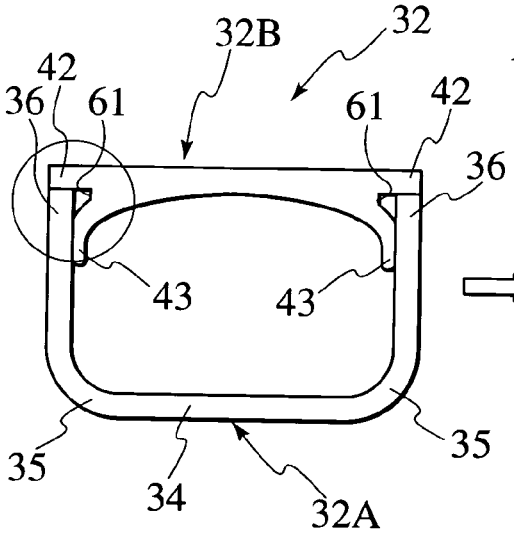
FIGS. 11A and 11B are views showing a pipe of a header tank according to a second embodiment of the present invention.
Figure 11B:
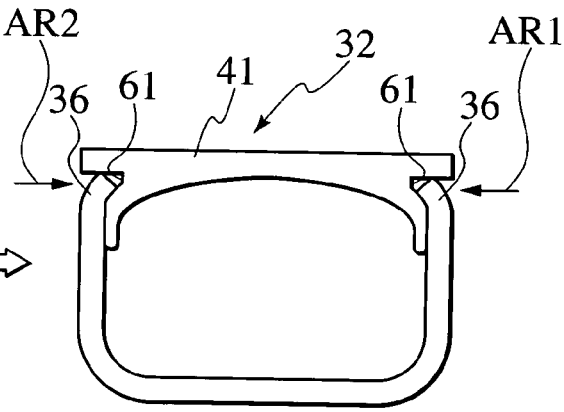

A caulking structure shown in FIGS. 11A and 11B is structured by arranging a groove 61 in base end portions of the joint projections 43 and 43 in the second separated body 32B and caulking the leading end portion of the straight portion 36 into the groove 61 by applying a caulking force in the directions of the arrows AR1 and AR2. In this case, since the leading end portion of the straight portion 36 is locked within the groove 61 of the joint projection 43, the temporary fixing between the first separated body 32A and the second separated body 32B is more securely achieved.

Figure 12A:
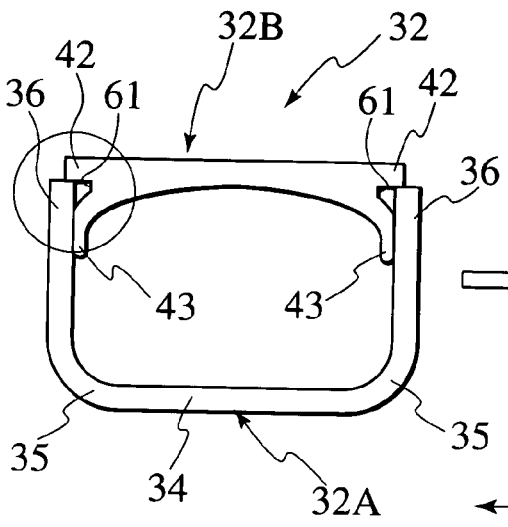
FIGS. 12A and 12B are views showing a pipe of a header tank according to a third embodiment of the present invention.
Figure 12B:
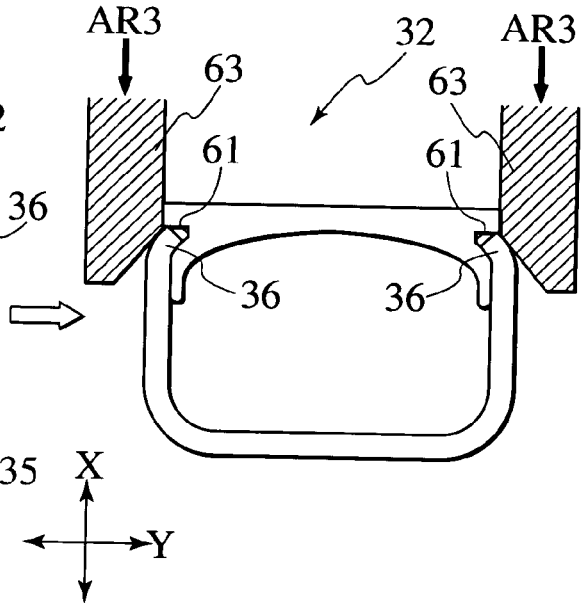

In this case, as in a caulking structure shown in FIGS. 12A and 12B, the structure may be made such that the leading end portion of the straight portion 36 is caulked to an inner side by setting the main body portion 41 (the abutment portion 42) of the second separated body 32B to be short in the width direction Y of the tube so as to operate a caulking punch 63 toward the longitudinal direction X of the tube (toward a direction of an arrow AR3 in FIG. 12B).

Figure 13A:
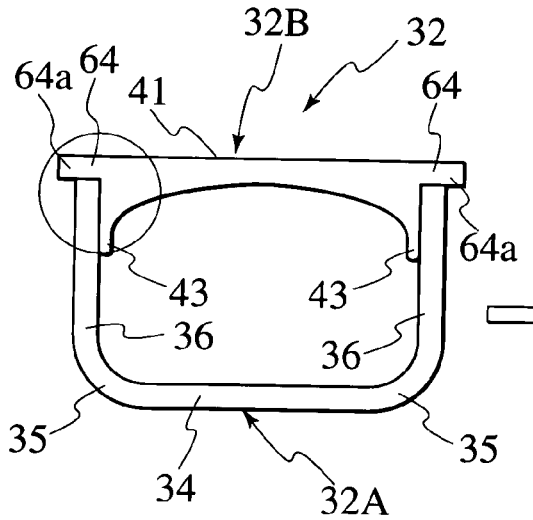
FIGS. 13A and 13B are views showing a pipe of a header tank according to a fourth embodiment of the present invention.
Figure 13B:
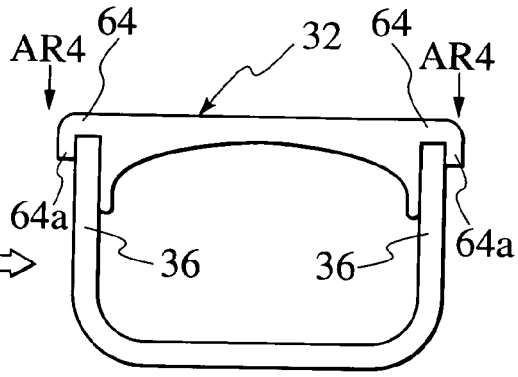

In a caulking structure shown in FIGS. 13A and 13B, protruding portions 64*a* and 64*a* protruded from the straight portions 36 and 36 are provided in an abutment portion 64 of the second separated body 32B. The first separated body 32A and the second separated body 32B can be temporarily fixed by applying an operating force to the protruding portions 64*a* and 64*a* in a direction of an arrow AR4 so as to fold back to the outer peripheral surface of the straight portions 36 and 36.

According to the structure, the first separated body 32A and the second separated body 32B can be temporarily fixed more securely than the conventional structure. In the case of FIGS. 13A and 13B, since the protruding portions 64*a* and 64*a* are arranged in an outer side of the straight portions 36 and 36, a space efficiency is lowered in comparison with the structure in which it is unnecessary that the portion protruding to the outer side over the straight portion 36 as shown in FIGS. 11A and 12A is provided.

As mentioned above, according to the present invention, in the structure in which the pipe of the header tank is formed by combining two separated bodies which are separated along the longitudinal direction, wherein the first separated body has the tube holding wall portion including the insertion hole inserting and holding the flat tube, and wherein a pair of straight portions protruded from the tube holding wall portion in the approximately orthogonal direction and formed along both sides of the tube in the width direction, and is formed in the C-shaped cross sectional shape.

In other words, it is possible to make the insertion depth of the tube short in comparison with the header tank having the circular cross sectional shape, by setting the first separated body to the C-shaped cross sectional shape, and it is possible to make the structure compact in the longitudinal direction of the tube while securing the same passage cross sectional area as that of the header tank having the circular cross sectional shape.

Figure 1:
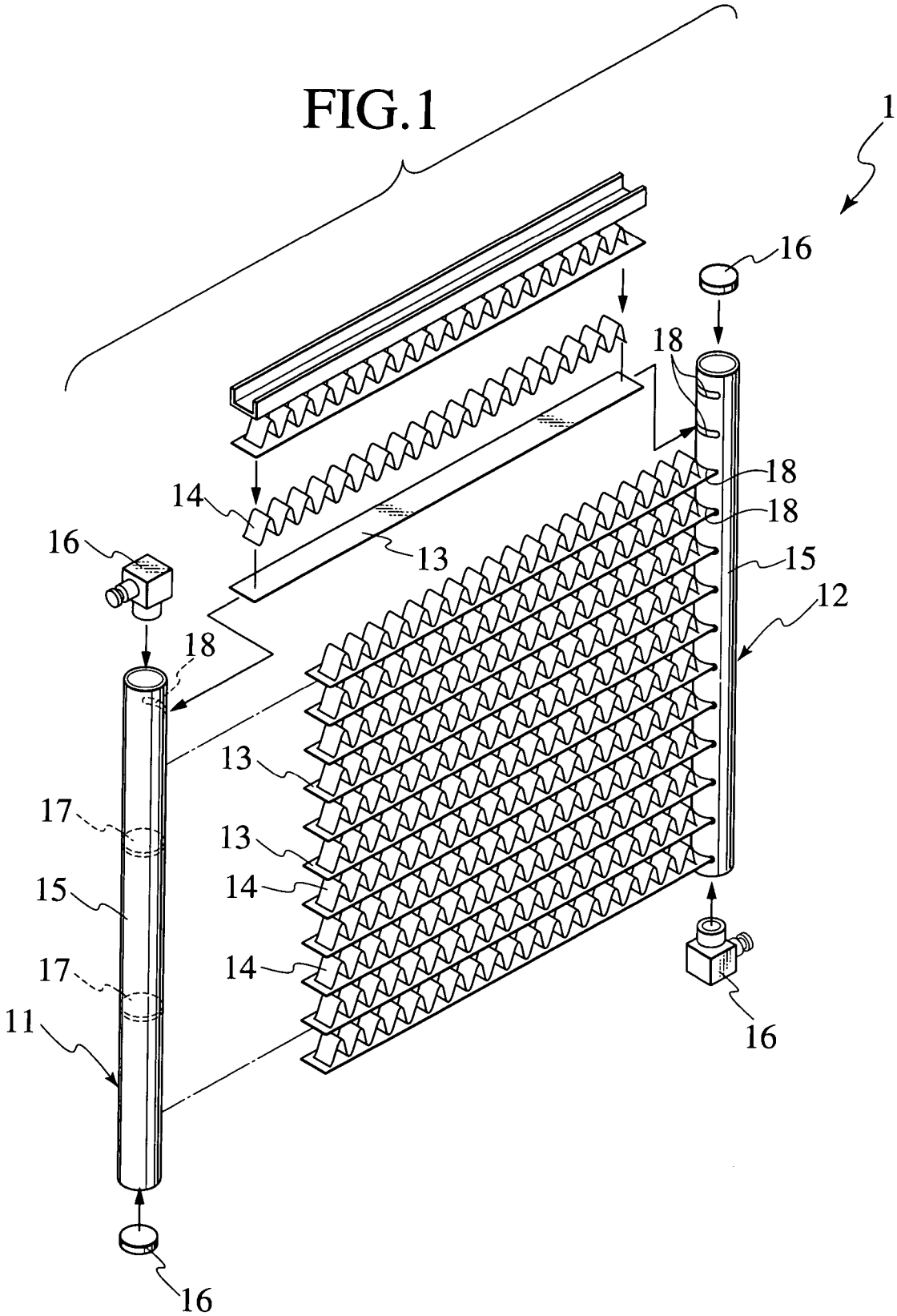
FIG. 1 is a perspective view showing a condenser as a conventional heat exchanger.
Figure 2:
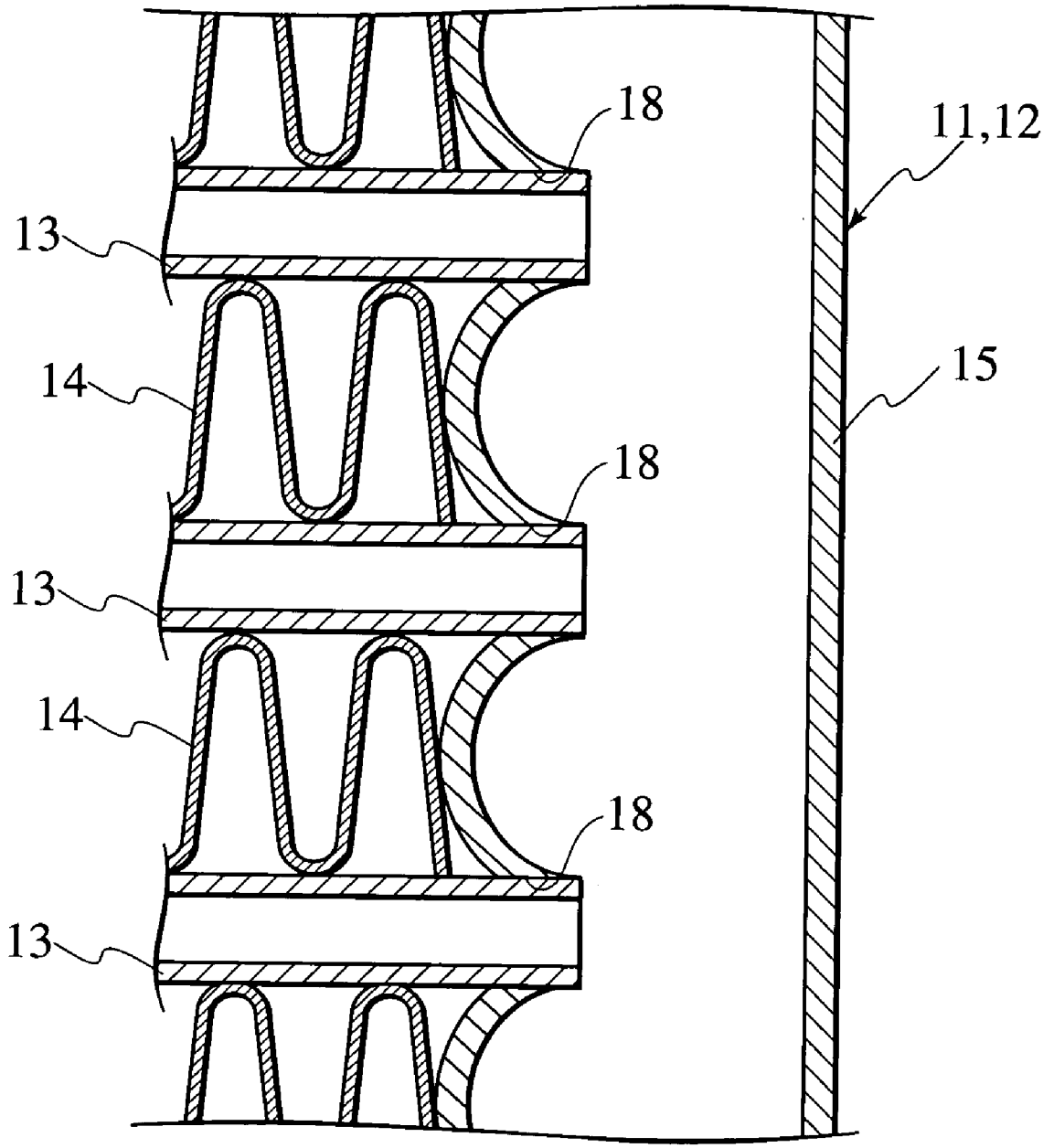
FIG. 2 is a cross sectional view in a longitudinal direction of a header tank for a condenser according to a conventional art.
Figure 3:
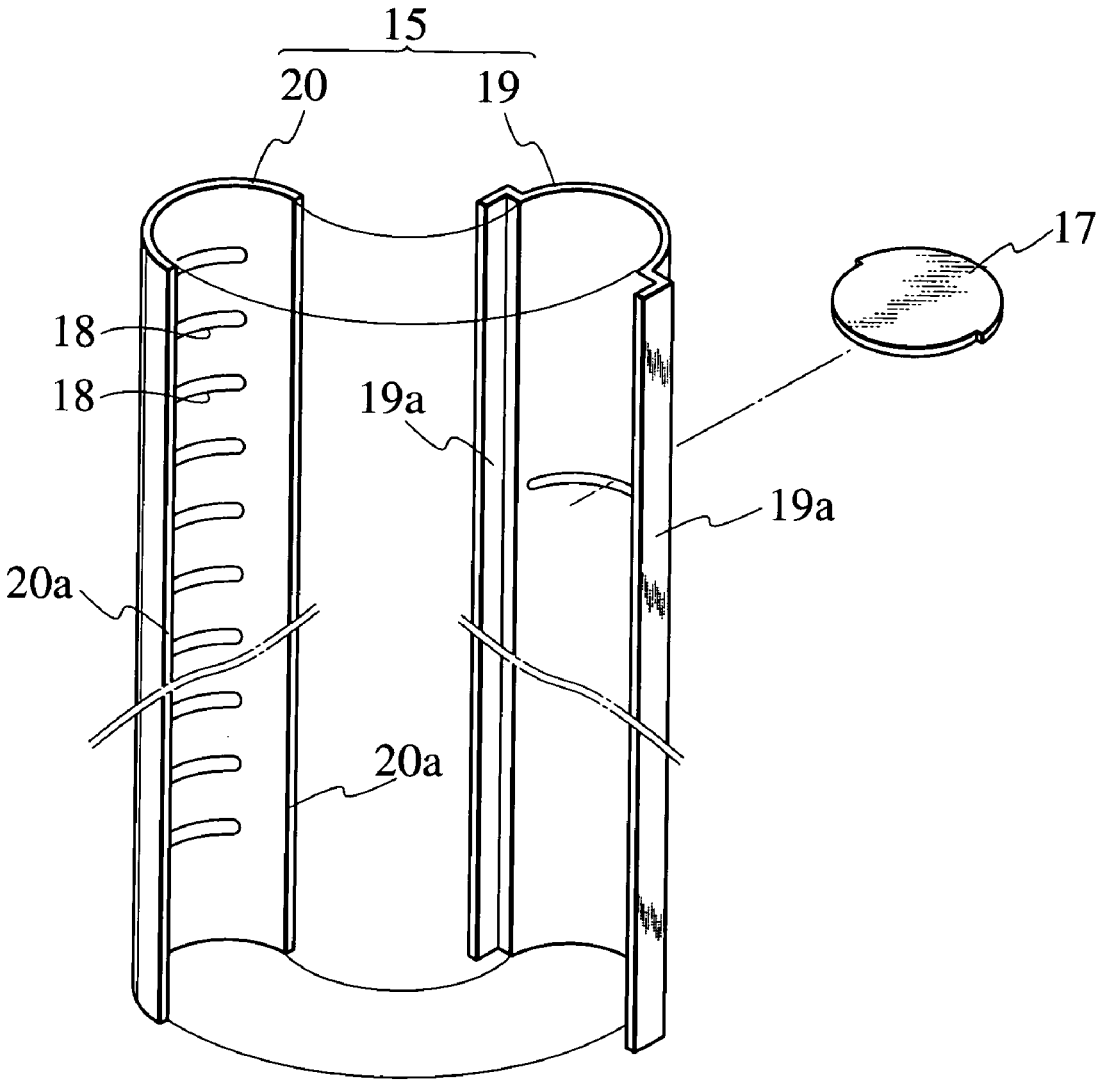
FIG. 3 is an exploded perspective view of a pipe of the header tank for the condenser according to the conventional art.
Figure 4A:
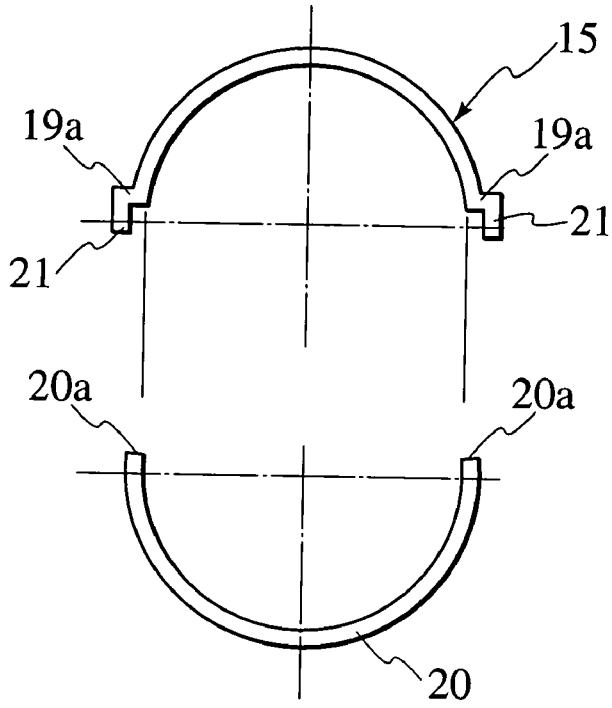
FIG. 4A is a cross sectional view of the pipe of the header tank for the condenser according to the conventional art, and shows an exploded state.
Figure 4B:
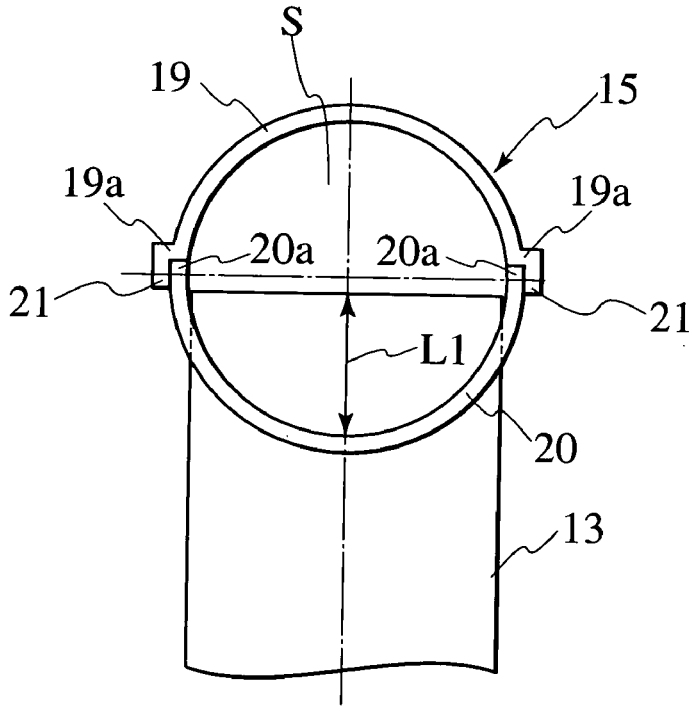
FIG. 4B is a cross sectional view of the pipe of the header tank for the condenser according to the conventional art, and shows a state in which a tube is inserted.

The present invention can be applied to various structures such as a heat radiator, a condenser, an evaporator and the like as far as it is a heat exchanger. However, it is particularly effective to apply to the condenser in which the width of the header tank becomes larger than the heat exchanging portion (the core portion) constituted by the tube and the fin as shown in FIG. 1.

What is claimed is:

1. A header tank for a heat exchanger in which a plurality of flat tubes are communicated and connected to at least a pair of the header tanks so as to form multiple stages, the header tank comprising:

a pipe having a first separated body and a second separated body; and a pair of closing members for closing opening portions in both ends of the pipe, wherein the first separated body includes a tube holding wall portion having insertion holes for holding the flat tubes and a pair of straight portions approximately parallel to one another, wherein the straight portions and the tube holding wall portion are formed in a C-shaped cross sectional shape, wherein the second separated body includes a main body portion closing an opening portion of the first separated body, abutment portions provided in both ends of the main body portion and abutted on leading end surfaces of the straight portions of the first separated body, and joint projections protruded from the main body portion and bonded to inner peripheral surfaces of leading end portions of the straight portions, wherein a width of the second separated body in a direction orthogonal to a longitudinal direction of the tube does not exceed a width of the first separated body in the direction orthogonal to the longitudinal direction of the tube, and wherein the leading end portions of the straight portions are accommodated in a space defined by the joint projections and the abutment portions.

2. A header tank for a heat exchanger according to claim 1, wherein the tube holding wall portion of the first separated body is formed in a flat shape which is orthogonal to the longitudinal direction of the tube.

3. A header tank for a heat exchanger according to claim 1, wherein the main body portion of the second separated body is formed by connecting the abutment portions to each other in an approximately linear shape so as to be approximately orthogonal to the longitudinal direction of the tube.

4. A header tank for a heat exchanger according to claim 3, wherein an inner peripheral surface of the main body portion in the second separated body is formed in a circular curved surface connecting the pair of joint projections to each other.

5. A header tank for a heat exchanger according to claim 1, wherein the leading end portions of the straight portions are caulked into the space.

6. A header tank for a heat exchanger according to claim 1, wherein at least base end portions of the joint projections in the second separated body are formed thicker than the straight portions of the first separated body along a caulking direction.

7. A header tank for a heat exchanger in which a plurality of flat tubes are communicated and connected to at least a pair of the header tanks so as to form multiple stages, the header tank comprising:

a pipe having a first separated body and a second separated body; and a pair of closing members for closing opening portions in both ends of the pipe, wherein the first separated body includes a tube holding wall portion having insertion holes for holding the flat tubes and a pair of straight portions approximately parallel to one another, wherein the straight portions and the tube holding wall portion are formed in a C-shaped cross sectional shape, and wherein the second separated body includes a main body portion closing an opening portion of the first separated body, abutment portions provided in both ends of the main body portion and abutted on leading end surfaces of the straight portions of the first separated body, and joint projections protruded from the main body portion and bonded to inner peripheral surfaces of leading end portions of the straight portions, wherein a width of the second separated body in a direction orthogonal to a longitudinal direction of the tube does not exceed a width of the first separated body measured across the straight portions of the first separated body in the direction orthogonal to the longitudinal direction of the tube; and wherein each of the leading end surfaces of the straight portions of the first separated body does not exceed the main body portion of the second separated body in the longitudinal direction of the tube.

8. A header tank for a heat exchanger according to claim 7, wherein the main body portion of the second separated body is formed by connecting the abutment portions to each other in an approximately linear shape so as to be approximately orthogonal to the longitudinal direction of the tube.

9. A header tank for a heat exchanger according to claim 8, wherein the inner peripheral surface of the main body portion in the second separated body is formed in a circular curved surface connecting the pair of joint projections to each other.

10. A header tank for a heat exchanger according to claim 7, wherein the tube holding wall portion of the first separated body is formed in a flat shape which is orthogonal to a longitudinal direction of the tube.

11. A header tank for a heat exchanger according to claim 7, wherein the leading end portions of the straight portions are caulked into a space.

12. A header tank for a heat exchanger according to claim 7, wherein at least base end portions of the joint projections in the second separated body are formed thicker than the straight portions of the first separated body along a caulking direction.

13. A header tank for a heat exchanger according to claim 7, wherein the main body portion of the second separated body has an approximately linear-shaped surface opposite to an inner peripheral surface of the main body portion, the approximately linear-shaped surface being substantially entirely a single flat face.

14. A header tank for a heat exchanger according to claim 13, wherein the approximately linear-shaped surface and the inner peripheral surface of the main body portion, in combination, define a thickness of the main body portion in the direction orthogonal to the longitudinal direction of the tube in such a manner that the main body portion is thicker toward each of the pair of the joint projections and thinner toward a center of the main body portion, and wherein the thickness of the main body portion is smallest in a center in the direction orthogonal to the longitudinal direction of the tube.

* * * * *